United States Patent [19]

Kahn

[11] 3,939,585

[45] Feb. 24, 1976

[54] FILING SYSTEM

[76] Inventor: Evelyn G. Kahn, 165 Stanwich Road, Greenwich, Conn. 06830

[22] Filed: July 25, 1974

[21] Appl. No.: 491,685

Related U.S. Application Data

[63] Continuation of Ser. No. 317,052, Dec. 20, 1972, abandoned.

[52] U.S. Cl. ..... 40/23 A

[51] Int. Cl.[2] ..... G09F 3/16

[58] Field of Search ..... 40/23 A, 23, 11, 11 A, 40/359, 360

[56] References Cited

UNITED STATES PATENTS

| | | | |
|---|---|---|---|
| 1,577,949 | 3/1926 | Butler | 40/23 A X |
| 1,723,011 | 8/1929 | Busco | 40/23 R |
| 2,938,252 | 5/1960 | Scheemaeker | 40/23 A X |

*Primary Examiner*—Robert Peshock
*Assistant Examiner*—Wenceslao J. Contreras
*Attorney, Agent, or Firm*—Kenyon & Kenyon Reilly Carr & Chapin

[57] ABSTRACT

A filing system using one or more sets of specially designed clips which may serve both to fasten materials together in the file and to provide a readily visible means of identifying different files is described. Each clip includes a front indicium member having the shape of a letter, numeral or other reference character, and a rear opposing member of suitable configuration, the two members cooperating to fasten together papers, cards, or other materials inserted between them. At the same time, the papers thereby fastened serve as a screen to hide the rear opposing member and provide a background which enhances the visibility of the front indicium member.

8 Claims, 6 Drawing Figures

FILING SYSTEM

This is a continuation of application Ser. No. 317,052, filed Dec. 20, 1972, now abandoned.

BACKGROUND OF THE INVENTION

1. Field of the Invention

The invention relates to systems for filing and indexing cards, papers, and similar documentary materials, and more specifically, relates both to clips and other fastening means for attaching such materials into segregated files, and to index tabs, spotters, and other means for locating particular files in filing systems.

2. Description of the Prior Art

Devices of various types for fastening papers, cards, and other documentary materials are old, including many varieties of paper clips both metal and plastic of various configurations. Spotters, index tabs, and other means for marking and identifying particular files are also known to be old.

In a few instances, clips and fastening devices which combine the function of fastening papers or cards and the function of providing a marked tab or other means for displaying a reference symbol for locating particular files have been proposed. Such devices have typically provided for a marking to be embossed, glued or otherwise added to a solid surface of the clip used to fasten papers. A marked sleeve designed to fit over an ordinary paper clip has also been previously described, thus permitting a portion of the paper clip to protrude and display the indicia on the sleeve, and the remainder of the clip, not covered by the sleeve, to hold the papers together.

Inasmuch as paper clips and similar fastening devices are typically small and inexpensive, previous proposals for affixing indicia to them usually contemplate only indicia of small size, a limitation which naturally detracts from the visibility of such markings and their usefulness as a means for indentifying and quickly locating files. To the extent an indicium is made larger, the surface upon which it is displayed, which does not contribute to the fastening function, must also be made larger, resulting in added cost and material waste, generally without increasing the capacity of the fastener. In the case of the sleeve designed to fit over a paper clip, increasing the size of the sleeve actually decreases the portion of the clip available to hold papers together.

SUMMARY OF THE INVENTION

It is therefore a principal object of this invention to provide a filing system for papers, cards and similar documentary materials which includes a set of inexpensive clips serving both to fasten such materials into segregated groups in the file and to provide large and easily readable indicia for quickly identifying and locating different files.

A further object of the invention is to provide a set of combined indexing and fastening clips for a filing system.

Still a further object of the present invention is to provide a set of combined indexing and fastening clips for filing systems which, because they employ a small amount of material, are inexpensive to manufacture, but nevertheless provide large and easily readable indicia for quick identification of the materials fastened by each clip.

These and other objects of the present invention are accomplished by the design and use in a filing system of one or more sets of combination indexing and fastening clips. Each clip in the set has a front indicium member which is formed or molded into the shape of a particular letter, numeral, or other reference character, and a rear opposing member which can be of any convenient configuration. The two opposing members are designed to lie either in the same plane or in approximately parallel planes in close proximity to each other when the clip is not in use, and are flexibly attached to each other at one or more resilient junction points near one edge, preferably the top, of the reference character. The flexible and resilient attachment permits the two opposing members to be separated sufficiently to permit the insertion of papers or cards between them up to the point or points of attachment, and, after release, urges them together towards their original position to bind the papers or cards together. At the same time, the papers or cards thus bound in the clip hide the rear opposing member and serve as a background against which the reference character of the front indicium member is prominently visible.

DESCRIPTION OF THE PREFERRED EMBODIMENTS

Figure 1:
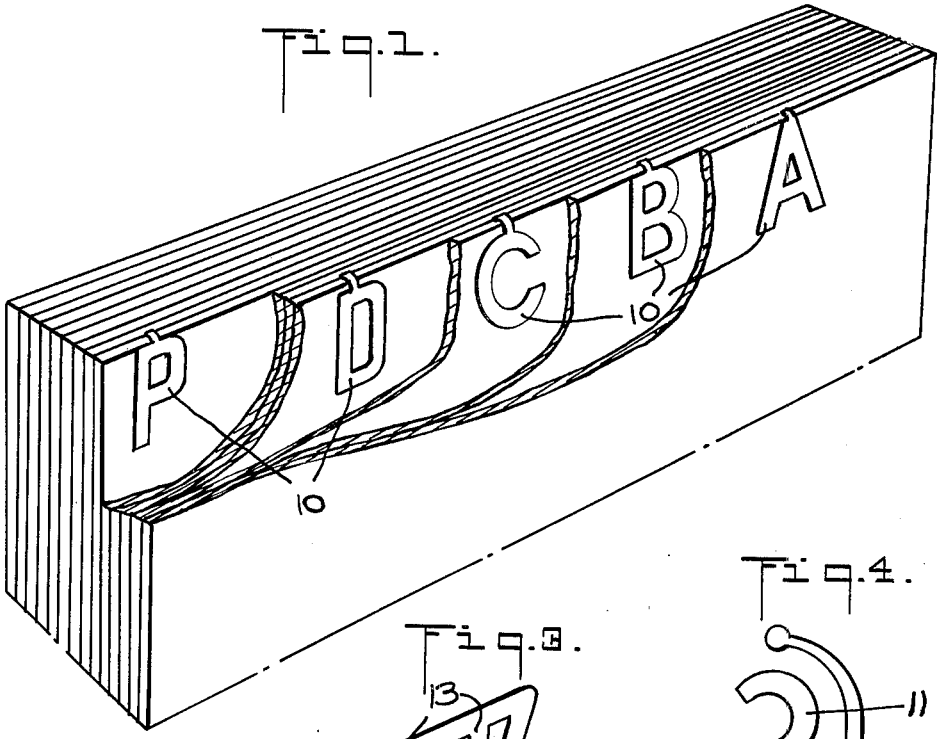
FIG. 1 is a perspective view of a file with portions cut away to illustrate the use and appearance of the combination indexing and fastening clips in a filing system in accordance with the invention.

The invention contemplates a filing system for papers, cards, and similar documentary materials which utilizes one or more sets of specially designed combination indexing and fastening clips, as shown generally at 10 in FIG. 1. Each clip includes a front indicium member, 11, and a rear opposing member, 12, the two members lying in the same or nearly the same plane, and being attached at one or more flexible and resilient junction points, 13.

The flexibility of the attachment permits the two members, 11 and 12, to be slightly separated except at the junction point, 13, to permit insertion of papers, cards, or other documentary materials to be fastened between the two members, 11 and 12. The resiliency at the junction points, 13, then urges the two members, 11 and 12, together toward their original position, thus binding the materials between them.

Figure 2:
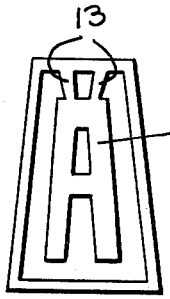
FIG. 2 is an elevational view of a combination indexing and fastening clip constructed in accordance with one embodiment of the invention.
Figure 3:
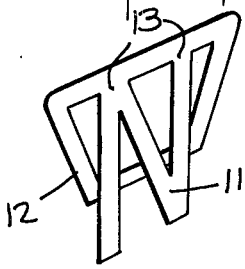
FIG. 3 is a perspective view of a combination indexing and fastening clip constructed in accordance with an alternative embodiment of the invention.
Figure 4:
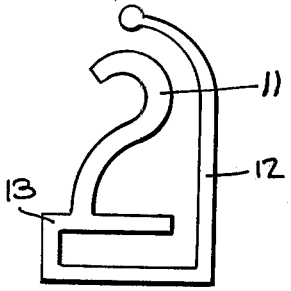
FIG. 4 is an elevational view of a combination indexing and fastening clip constructed in accordance with an alternative embodiment of the invention.

In the preferred embodiment, the two members, 11 and 12, are designed to lie in the same plane as shown in FIGS. 2 and 4. This design has the advantage of permitting the clips to be cut from sheet material, or in the case of plastics, to be injection molded in a simple mold. In the alternative, the two members, 11 and 12, can lie in nearly parallel planes disposed in close proximity to each other, as shown in FIG. 3. The design of FIG. 3 is equally useful in a filing system, but the clips may not be as economical to manufacture.

The front indicium member, 11, of each clip in a set is formed or molded in the shape of a letter, numeral, or other suitable reference character, each clip in a given set having its front indicium member in the shape of a different character. It is thus apparent that when the clip is used to bind papers or cards in a file, the front indicium member, 11, in addition to cooperating with the rear opposing member, 12, to fasten the cards or papers, serves as a means for quickly locating and identifying the cards or papers fastened.

The visibility of the particular reference character of each clip is specifically enhanced by the papers bound, which serve as a background for the front indicium member, 11, and as a screen to hide the rear opposing member, 12. Files in the system thus have the appearance of the files shown in FIG. 1.

Figure 5:
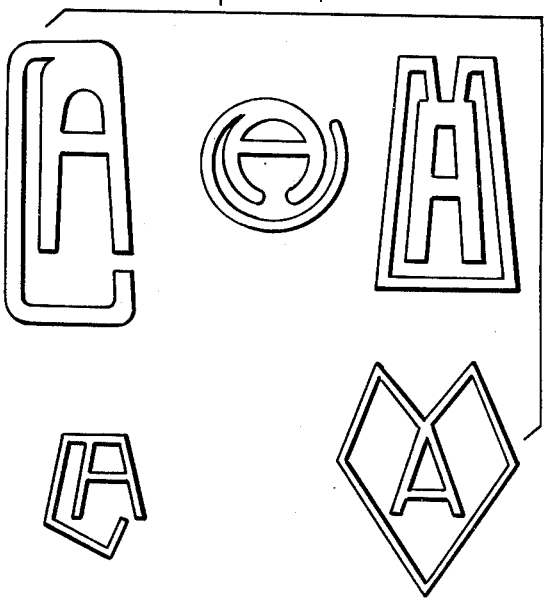
FIG. 5 is an elevational view of combination indexing and fastening clips constructed in accordance with alternative embodiments of the invention.
Figure 6:
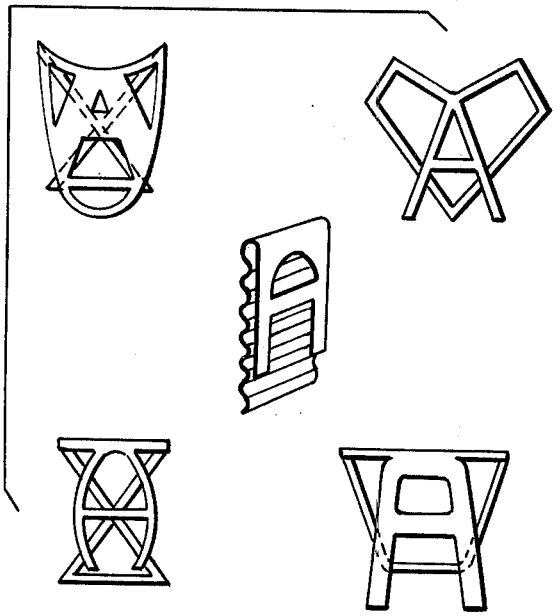
FIG. 6 is an elevational view of combination indexing and fastening clips constructed in accordance with alternative embodiments of the invention.

The rear opposing member, 12, can be of any suitable configuration, such as the closed polygon shown in FIGS. 2 or 3, a loop, or an open configuration such as the hook shown in FIG. 4. Further examples are shown in FIGS. 5 and 6. In the preferred embodiment, wherein the two members, 11 and 12, lie in the same plane, however, it will be appreciated that the rear opposing member, 12, for any particular indicium must be designed not to intersect the front member 11 comprising that indicium.

The junction point or points, 13, are located at one edge of the reference character to permit full utilization of the front indicium member, 11, in both its indexing and fastening function, by thus permitting the insertion of papers or cards all the way into the clip up to the junction points, 13. Preferably, the junction points, 13, are located at the top of the reference character, as shown in FIGS. 2 and 3, although, where it is desired to fasten papers on the side, clips can be designed with the junction point or points at one side, as shown in FIG. 4, or on the other side.

It will be appreciated that the front indicium member, 11, being in the shape of a suitable letter, numeral, or other reference character, provides a far more visible and striking means of quickly identifying the file than a flat surface with an indicium merely drawn or embossed thereon, while at the same time utilizing considerably less material than a flat surface large enough to display an indicium of the same size.

Moreover the clips can be made of brightly colored materials to further enhance the visibility of the reference characters in contrast to the ordinary white or subdued colors of documentary materials. In addition, different colored sets can be combined in a more extensive filing system to increase the variety of reference characters. It will be appreciated that where the color of the clip is different than that of the papers being fastened, a contrast is provided between indicium and background without the expense of coloring indicia differently from the background on which they might be embossed.

The flexibility of paper permits the papers bound in the clip to be depressed along the irregular configuration or openings of the front indicium member, 11, in one direction, while simultaneously being depressed along the configuration of the rear opposing member, 12, in the opposite direction. It is thus apparent that a clip desiged in accordance with the invention tends to create an irregular pattern of slight wrinkles in the paper which provides a stronger gripping action than a clip with a flat surface having an indicium embossed thereon, which is more likely to slip off.

In further embodiments of the invention, illustrated in FIGS. 5 and 6, the clips have been designed to achieve the indexing and filing legibly, and with grace and beauty.

The particular embodiments described herein are by way of illustration only. Other designs, modifications, and embodiments of the invention will undoubtedly suggest themselves to those skilled in the art and still be within the scope of the invention, which is limited only by the following claims.

What is claimed is:

1. A filing system comprising a plurality of combination indexing and fastening clips, each clip having a front indicium member and a rear opposing member attached to the front indicium member at the top thereof, the rear opposing member lying in substantially the same plane as the front indicium member and having a configuration surrounding and enclosing the sides and bottom of the front indicium member in non-intersecting relationship thereto, the front indicium member having a shape consisting of a particular reference character defined by the front indicium member of each clip in the set being readily distinguishable from the reference character defined by every other clip in the set, the rear opposing member having a torsionally resilient portion at the top thereof, said torsionally resilient portion being biased to hold the front indicium member and the rear opposing member in substantially the same plane and having two aligned bar-shaped elements each extending across a portion of the top of the front indicium member, the front indicium member being attached to the rear opposing member by two connecting arms each extending from the top of the reference character to one of said bar-shaped elements, whereby any separation of the planes of the front indicium member and the rear opposing member rotates the connecting arms and twists the torsionally resilient bar-shaped elements thereby giving rise to a resilient opposing force which tends to realign the front indicium member and the rear opposing member in substantially the same plane, and whereby when documentary materials are inserted between the front indicium member and the rear opposing member, the torsionally resilient portions of the rear opposing member bias the front indicium member and the rear opposing member toward substantially the same plane thereby securely binding the documentary materials therebetween.

2. The filing system of claim 1 wherein the shape of the particular reference character of each clip is the shape of a letter of the alphabet.

3. The filing system of claim 1 wherein the shape of the particular reference character of each clip is the shape of a numeral.

4. The filing system of claim 1 wherein the shape of the particular reference character of each clip is the shape of a combination of symbols selected from the group consisting of letters of the alphabet, numerals, punctuation marks, mathematical symbols, Greek letters and scientific symbols.

5. The filing system of claim 1 wherein the shape of the particular reference character of each clip is the shape of a reference symbol selected from the group consisting of punctuation marks, mathematical symbols, Greek letters and scientific symbols.

6. A combination indexing and fastening clip for use in a filing system comprising a front indicium member, a rear opposing member, the front indicium member having the shape of a particular reference character, the rear opposing member lying in substantially the same plane as the front indicium member and having a configuration surrounding and enclosing the opposing sides of the front indicium member in non-intersecting relationship thereto, and torsionally resilient attachment means for attaching the front indicium member to the rear opposing member at the top of the reference character, said means being biased to hold the front indicium member and the rear opposing member in substantially the same plane, and said means including a torsionally resilient portion of the rear opposing member at the top thereof and one or more connecting arms extending from the top of the reference character to the torsionally resilient portion of the rear opposing member, whereby when documentary materials are inserted between the front indicium member and the rear opposing member the torsionally resilient attachment means biases the front indicium member and the rear opposing member toward substantially the same plane thereby securely binding the documentary materials therebetween.

7. A combination indexing and fastening clip for use in a filing system comprising a front indicium member, a rear opposing member, the front indicium member having the shape of a particular reference character which is a letter of the alphabet, the rear opposing member lying in substantially the same plane as the front indicium member and having a configuration surrounding and enclosing the opposing sides of the front indicium member in non-intersecting relationship thereto, and torsionally resilient attachment means for attaching the front indicium member to the rear opposing member at the top of the reference character, said means being biased to hold the front indicium member and the rear opposing member in substantially the same plane, whereby when documentary materials are inserted between the front indicium member and the rear opposing member the torsionally resilient attachment means biases the front indicium member and the rear opposing member toward substantially the same plane thereby securely binding the documentary materials therebetween.

8. A combination indexing and fastening clip for use in a filing system comprising a front indicium member, a rear opposing member, the front indicium member having the shape of a particular reference character which is a numeral, the rear opposing member lying in substantially the same plane as the front indicium member and having a configuration surrounding and enclosing the opposing sides of the front indicium member in non-intersecting relationship thereto, and torsionally resilient attachment means for attaching the front indicium member to the rear opposing member at the top of the reference character, said means being biased to hold the front indicium member and the rear opposing member in substantially the same plane, whereby when documentary materials are inserted between the front indicium member and the rear opposing member the torsionally resilient attachment means biases the front indicium member and the rear opposing member toward substantially the same plane thereby securely binding the documentary materials therebetween.

* * * * *

UNITED STATES PATENT OFFICE

CERTIFICATE OF CORRECTION

Patent No. 3,939,585 Dated February 24, 1976

Inventor(s) Evelyn G. Kahn

It is certified that error appears in the above-identified patent and that said Letters Patent are hereby corrected as shown below:

Column 4, line 28, claim 1, after word "character", words -- , the reference character -- have been omitted.

Signed and Sealed this

Thirteenth Day of July 1976

[SEAL]

*Attest:*

RUTH C. MASON
*Attesting Officer*

C. MARSHALL DANN
*Commissioner of Patents and Trademarks*